US008042933B2

(12) United States Patent
Beltman et al.

(10) Patent No.: US 8,042,933 B2
(45) Date of Patent: Oct. 25, 2011

(54) FORCELESS SUPPORT FRAME FOR PRINTHEAD SHUTTLE IN DIGITAL PRINTERS

(75) Inventors: Arend-Jan Beltman, Best (NL); Albert Brals, Beek en Donk (NL); Werner Van De Wynckel, Wolvertem (BE); Bart Verhoest, Niel (BE); Bart Verlinden, Tongeren (BE)

(73) Assignee: Agfa Graphics NV, Mortsel (BE)

( * ) Notice: Subject to any disclaimer, the term of this patent is extended or adjusted under 35 U.S.C. 154(b) by 1019 days.

(21) Appl. No.: 11/919,288

(22) PCT Filed: May 8, 2006

(86) PCT No.: PCT/EP2006/062051
§ 371 (c)(1),
(2), (4) Date: Oct. 25, 2007

(87) PCT Pub. No.: WO2006/120157
PCT Pub. Date: Nov. 16, 2006

(65) Prior Publication Data

US 2009/0066750 A1 Mar. 12, 2009

Related U.S. Application Data

(60) Provisional application No. 60/709,312, filed on Aug. 18, 2005.

(30) Foreign Application Priority Data

May 9, 2005 (EP) ..... 05103834
May 30, 2005 (EP) ..... 05104601

(51) Int. Cl.
*B41J 29/13* (2006.01)

(52) U.S. Cl. ..... 347/108

(58) Field of Classification Search ..... None
See application file for complete search history.

(56) References Cited

U.S. PATENT DOCUMENTS

| | | | | |
|---|---|---|---|---|
| 4,198,642 | A | 4/1980 | Gamblin | |
| 4,967,203 | A | 10/1990 | Doan et al. | |
| 5,026,186 | A | 6/1991 | Hasegawa | |
| 5,141,201 | A * | 8/1992 | Mizuno et al. | 248/550 |
| 5,338,121 | A * | 8/1994 | Kobayashi et al. | 400/322 |
| 5,365,839 | A | 11/1994 | Yoshino | |
| 6,024,506 | A | 2/2000 | Eum | |
| 6,679,583 | B2 | 1/2004 | Vanhooydonck et al. | |
| 2003/0007023 | A1 * | 1/2003 | Barclay et al. | 347/8 |

(Continued)

FOREIGN PATENT DOCUMENTS

EP 1721748 A1 11/2006

(Continued)

*Primary Examiner* — Matthew Luu
*Assistant Examiner* — Kendrick Liu
(74) *Attorney, Agent, or Firm* — Keating & Bennett, LLP

(57) ABSTRACT

In a digital printer the elements involved directly in the print process, which are located on a shuttle assembly are mounted upon a metrological frame which is isolated from the base frame by vibration dampers. Because the elements of the shuttle drive systems, such as a belt drive system having a motor and pulleys, are mounted upon the base frame, the drive and reaction forces from the motor drive systems are led to the base frame while the shuttles assembly is guided by the force-free, vibration free metrological frame. This allows for higher accuracy during printing as the metrological frame serves as a vibration free reference element.

11 Claims, 5 Drawing Sheets

U.S. PATENT DOCUMENTS

| | | | |
|---|---|---|---|
| 2004/0155923 | A1 | 8/2004 | Ikeda |

FOREIGN PATENT DOCUMENTS

| | | | |
|---|---|---|---|
| EP | 1721755 | A1 | 11/2006 |
| EP | 1721756 | A1 | 11/2006 |
| JP | 59136280 | | 8/1984 |
| JP | 59209177 | | 11/1984 |
| JP | 2001270180 | | 10/2001 |
| WO | WO 02/053383 | A2 | 7/2002 |
| WO | WO 02/053383 | A3 | 7/2002 |
| WO | WO2006/120156 | A1 | 11/2006 |
| WO | WO 2006/120158 | A1 | 11/2006 |
| WO | WO 2006/120159 | A1 | 11/2006 |

* cited by examiner

FORCELESS SUPPORT FRAME FOR PRINTHEAD SHUTTLE IN DIGITAL PRINTERS

This application is a national stage filing under 35 USC §371 of PCT application no. PCT/EP2006/062051 filed May 8, 2006 which claims priority to EP application no. 05103834.7 filed May 9, 2005, EP application no. 05104601.9 filed May 30, 2005, and U.S. provisional patent application No. 60/709,312 filed Aug. 18, 2005.

FIELD OF THE INVENTION

The present invention relates to a digital printing system. More specifically the invention is related a system for reducing the effect of drive and reaction forces of the motor system in an inkjet printing apparatus.

BACKGROUND OF THE INVENTION

Inkjet Printing

Printing is one of the most popular ways of conveying information to members of the general public. Digital printing using dot matrix printers allows rapid printing of text and graphics stored on computing devices such as personal computers. These printing methods allow rapid conversion of ideas and concepts to printed product at an economic price without time consuming and specialised production of intermediate printing plates such as lithographic plates. The development of digital printing methods has made printing an economic reality for the average person even in the home environment.

Conventional methods of dot matrix printing often involve the use of a printing head, e.g. an ink jet printing head, with a plurality of marking elements, e.g. ink jet nozzles. The marking elements transfer a marking material, e.g. ink or resin, from the printing head to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme, (e.g. CMYK plus one or more additional spot or specialised colours). To print a printing medium such as paper or plastic, the marking elements are used or "fired" in a specific order while the printing medium is moved relative to the printing head. Each time a marking element is fired, marking material, e.g. ink, is transferred to the printing medium by a method depending on the printing technology used. Typically, in one form of printer, the head will be moved relative to the printing medium to produce a so-called raster line which extends in a first direction, e.g. across a page. The first direction is sometimes called the "fast scan" direction. A raster line comprises a series of dots delivered onto the printing medium by the marking elements of the printing head. The printing medium is moved, usually intermittently, in a second direction perpendicular to the first direction. The second direction is often called the slow scan direction.

The combination of printing raster lines and moving the printing medium relative to the printing head results in a series of parallel raster lines, which are usually closely spaced. Seen from a distance, the human eye perceives a complete image and does not resolve the image into individual dots provided these dots are close enough together. Closely spaced dots of different colours are not distinguishable individually but give the impression of colours determined by the amount or intensity of the three colours cyan, magenta and yellow which have been applied.

In order to improve the veracity of printing, e.g. of a straight line, it is preferred if the distance between dots of the dot matrix is small, that is the printing has a high resolution. Although it cannot be said that high resolution always means good printing, it is true that a minimum resolution is necessary for high quality printing. A small dot spacing in the slow scan direction means a small distance between marker elements on the head, whereas regularly spaced dots at a small distance in the fast scan direction places constraints on the quality of the drives used to move the printing head relative to the printing medium in the fast scan direction.

Generally, there is a mechanism for positioning a marker element in a proper location over the printing medium before it is fired. Usually, such a drive mechanism is controlled by a microprocessor, a programmable digital device such as a PAL, a PLA, a FPGA or similar although the skilled person will appreciate that anything controlled by software can also be controlled by dedicated hardware and that software is only one implementation strategy.

Most number of such prints are produced in the home and office environment using small apparatus capable of printing on relative small areas only. Most popular paper formats are standard office formats such as the ISO 216 A4 paper size and the ANSI/ASME Y14.1 Letter format. Larger size printers usually can print on ISO 216 A3 or ANSI/ASME Y14.1 Tabloid format.

In all, these printers are limited in size and throughput.

In recent times e.g. inkjet printers have evolved to more industrial applications. A lot of these printers can handle larger paper formats or use special types of ink.

Preferably these industrial printers are capable of printing on large paper sized and obtain a high throughput. Sizes up to 200×280 cm are desirable as output format. Special applications are e.g. poster printing, advertising . . . .

To obtain a higher throughput usually several printhead are used at the same time.

To improve the clarity and contrast of the printed image, recent research has been focused to improvement of the used inks. To provide quicker, more waterfast printing with darker blacks and more vivid colours, pigment based inks have been developed. These pigment-based inks have a higher solid content than the earlier dye-based inks. Both types of ink dry quickly, which allows inkjet printing mechanisms to forms high quality images.

In some industrial applications, such as making of printing plates using ink-jet processes, inks having special characteristics causing specific problems.

E.g. UV curable inks exist to allow rapid hardening of inks after printing. An example can be found in WO 02/53383. A special UV source has then to be provided for curing the inks after printing. After the ink of a printed band has been partially cured by the UV source, the band can be immediately be overprinted without the problem that the ink drops will mix causing artefacts.

Using this ink allows for the use of high quality printing methods at a high speed avoiding several other problems inherent to the nature of the recording method.

One general problem of dot matrix printing is the formation of artefacts caused by the digital nature of the image representation and the use of equally spaced dots.

Certain artefacts such as Moiré patterns may be generated due to the fact that the printing attempts to portray a continuous image by a matrix or pattern of (almost) equally spaced dots.

Another source of artefacts can be errors in the placing of dots caused by a variety of manufacturing defects such as the location of the marker elements in the head or systematic errors in the movement of the printing head relative to the printing medium. In particular, if one marking element is misplaced or its firing direction deviates from the intended direction, the resulting printing will show a defect which can run throughout the length of the print. A variation in drop velocity will also cause artefacts when the printing head is moving as time of flight of the drop will vary with variation in the velocity. Similarly, a systematic error in the way the printing medium is moved relative to the printing medium may result in defects which may be visible. For example, slip between the drive for the printing medium and the printing medium itself will introduce errors. In fact, any geometrical limitation of the printing system can be a source of errors, e.g. the length of the printing head, the spacing between marking elements, the indexing distance of the printing medium relative to the head in the slow scan direction. Such errors may result in "banding" that is the distinct impression that the printing has been applied in a series of bands. The errors involved can be very small—the colour discrimination, resolution and pattern recognition of the human eye are so well developed that it takes remarkably little for errors to become visible.

To alleviate some of these errors it is known to alternate or vary the use of marker elements so as to spread errors throughout the printing so that at least some systematic errors will then be disguised. For example, one method often called "shingling" is known from U.S. Pat. No. 4,967,203 which describes an ink jet printer and method. Each printing location or "pixel" can be printed by four dots, one each for cyan, magenta, yellow and black. Adjacent pixels on a raster line are not printed by the same nozzle in the printing head. Instead, every other pixel is printed using the same nozzle. In the known system the pixels are printed in a checkerboard pattern, that is, as the head traverses in the fast scan direction a nozzle is able to print at only every other pixel location. Thus, any nozzle which prints consistently in error does not result in a line of pixels in the slow scan direction each of which has the same error. However the result is that only 50% of the nozzles in the head can print at any one time. In fact, in practice, each nozzle prints at a location which deviates a certain amount from the correct position for this nozzle. The use of shingling can distribute these errors through the printing. It is generally accepted that shingling is an inefficient method of printing as not all the nozzles are used continuously and several passes are necessary.

Another method of printing is known as "interlacing", e.g. as described in U.S. Pat. No. 4,198,642. The purpose of this type of printing is to increase the resolution of the printing device. That is, although the spacing between nozzles on the printing head along the slow scan direction is a certain distance X, the distance between printed dots in the slow scan direction is less than this distance. The relative movement between the printing medium and the printing head is indexed by a distance given by the distance X divided by an integer. More sophisticated printing schemes can be found in e.g. European application EP 01000586 and U.S. Pat. No. 6,679,583.

Another problem is that high acceleration values are needed when the shuttle starts printing. Acceleration can be up to 10 $m/s^2$.

Lower acceleration values to reach high printing speeds would give less problems regarding vibrations but would lead to loss of time due to longer run-up time and inevitably longer run-up distance leading to even larger dimensions of the overall apparatus giving rise to more problems of stability.

Thus these industrial printers usually comprise:

- large size recording units
- use of multiple heads
- heavier weight
- high speed movements over long distances
- higher accelerations
- complicate recording schemes (shingling, interlacing, . . . )
- large ink reservoirs with online replenishment of the ink tanks on the printhead shuttle.

and can further also comprise:

- UV pre-curing installation
- cooling means
- cabling and ink transport tubes.

To enable high quality recording a precise and reproducible positioning and control of the printing unit is needed in these industrial machines. For high quality printing the dot placement accuracy is set to about 5μ, while dots printed have a size in of about 30μ. However depending upon the application of the printer accuracy and dot size may vary.

The positioning systems used in the state of the art home and office printers can not be simply enlarged to be used in the industrial printing apparatus.

In JP20012701870 a method is provided for driving a carriage of an inkjet printer wherein the belt drive system has two motors, one stepping motor an done DC motor which is used during acceleration of the carriage.

In U.S. Pat. No. 5,365,839 use is made of a shuttle and a balance shuttle driven by linear motors.

Several problems arise

- inertia problems due to higher weight of printhead and utility components (UV source, . . . ).
- bending of the frame due to gravitation or drive forces of the motor system.
- torsion of large size spindles.
- strain due to tension on the components of the shuttle drive system.
- insufficient rigidity of the apparatus frame leading deformation due to stress forces and incorrect resulting in incorrect placement of dots and incorrect recording distance of the printhead over the receiver.
- cost of a large high accuracy shuttle drive system, e.g. long stroke linear motors are very expensive.

The large forces needed to drive the printing shuttle lead to vibrations giving printing defects as the reference points of the print head positioning system and the receiver positioning are not rigidly fixed to each other. It can be considered that the axis x of the co-ordinate system of the printhead drive and receiver are not locked to each other.

Certain industrial printers use a low number of printheads, keeping weight of the printing shuttle down, thus having the negative effect that throughput is very low.

Other types use more printheads but need a very expensive paper drive system to ensure accuracy.

Some industrial printers are only capable of low quality end products such as those used in large-size advertising boards.

It is clear that the state of the art driving mechanism of office printers are not capable of driving the large printing shuttles of industrial printers at the needed speed and accuracy.

It is clear that to obtain a high throughput, high quality industrial inkjet printing apparatus am improved printing shuttle has to be developed having high accuracy over a large area and capable to perform a high speeds and acceleration values.

SUMMARY OF THE INVENTION

The above-mentioned advantageous effects are realised by a system having the specific features set out in claim 1. Specific features for preferred embodiments of the invention are set out in the dependent claims.

Further advantages and embodiments of the present invention will become apparent from the following description and drawings.

DETAILED DESCRIPTION OF THE INVENTION

The present invention provides a more accurate shuttle drive system reducing possible printing errors at a reasonable cost by providing a configuration wherein reaction forces due to the acceleration of the printhead shuttle are deviated from the imaging module by use of separate frame for the printing module and receiver which is kept forceless and vibration free.

Further advantages are realised by

- reducing the weight of the printhead shuttle carrying the printing heads and which needs to be exactly positioned relative to the receiver.
- an improved but relative inexpensive, high accuracy transport system using an motor in motor concept
- actively avoiding vibrations during printing by an adapted control loop, having a digital filter, in the head transport system

PREFERRED EMBODIMENT

Figure 1:
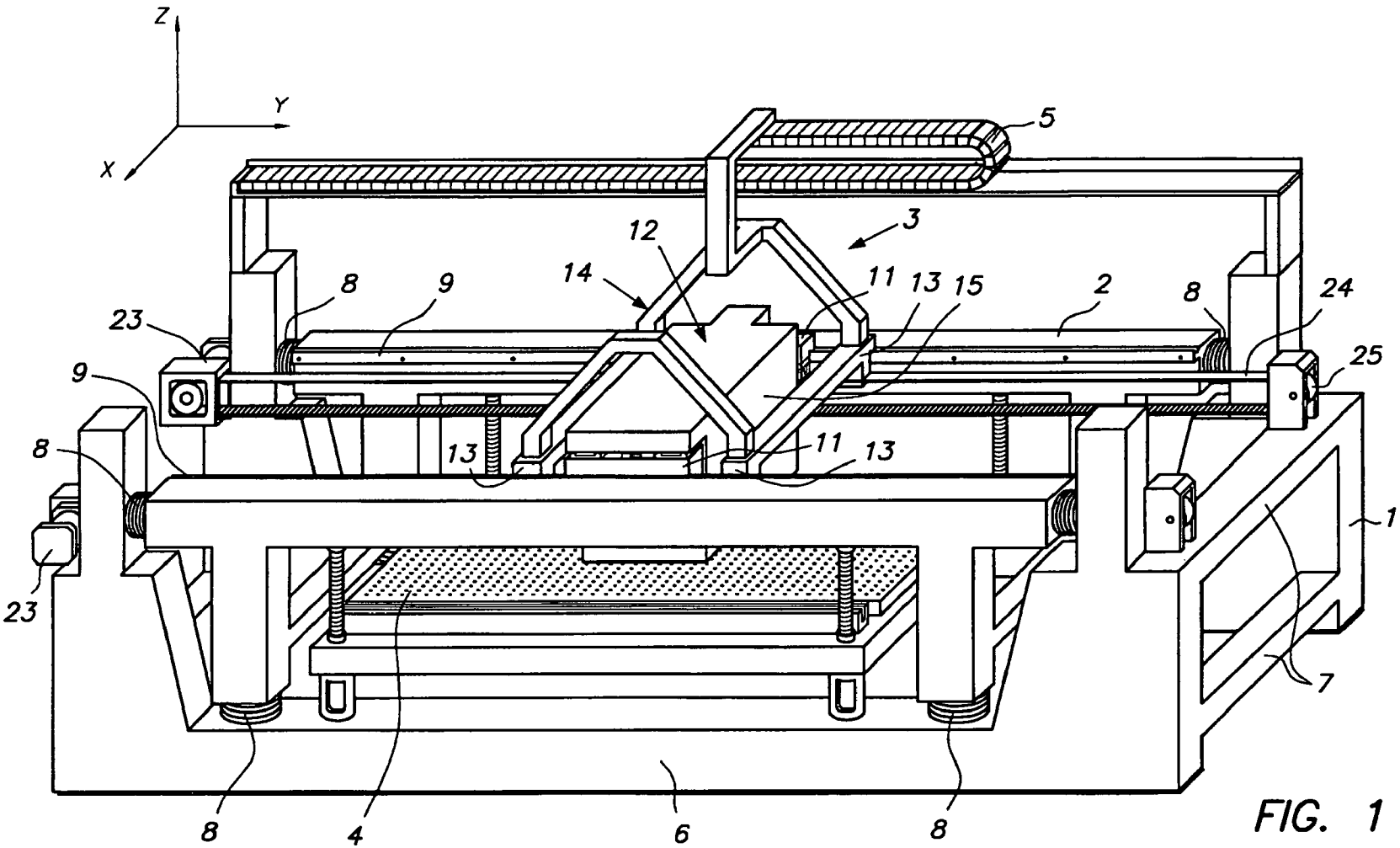
FIG. 1 is a general overview showing the main constituents of the industrial printing apparatus.

While the present invention will hereinafter be described in connection with preferred embodiments thereof, it will be understood that it is not intended to limit the invention to those embodiments. In FIG. 1 a non-detailed overview is given showing the main constituents of the industrial printing apparatus:

- base frame 1
- metrological or metro frame 2
- shuttle assembly 3
- receiver table 4
- cable carrier 5

Base Frame

The base frame 1 of the apparatus has several functions:

- it forms the mounting base for the printing mechanism and all other components of the printer,
- the frame 1 also supports the paper feed mechanics and carries e.g. the motors for the scanning movement of the shuttle assembly 3.
- the base frame 1 also helps to cope with forces generated during printing,
- It contains necessary modules as the power supply, ink supply, vacuum pumps, electronics, etc.

The frame 1 is directly placed on the floor and has to be very stiff and have a high weight to avoid deformation and vibrations due to forces exerted upon the base frame 1 of the various apparatus components or environment.

The frame 1 is composed of two long side beams 6 which are coupled to each other by traverse beams 7. The whole is further stabilised by use of diagonal fortifications (not shown).

Overall size of the base frame 1 in the preferred embodiment is about 250 cm×600 cm.

Metro Frame

According to the invention the metro frame 2 is intended to support all the components involved in the imaging process during printing. The aim is to isolate the metro frame 2 from forces giving vibrations and create a force-free and vibrationless base for the imaging process.

Preferably the metro frame 2 itself is indirectly supported by the base frame 1 via vibration isolators 8.

Horizontally the metro frame 2 is also isolated from the base frame 1 to avoid the transmission of vibrations.

It also has a high stiffness to avoid deformations of the frame 2 during printing.

The metro frame 2 provides

- guide rails 9 for guidance of the shuttle assembly 3, one at each side of the frame 2,
- at least one encoder 10 to enable exact positioning of the shuttle
  - The metro frame 2 acts as reference frame for at least all components directly involved in the imaging system, i.e. the printheads and receiver The size of the metro frame 2 is in between the size of the receiver table 4 and the base frame 1 and is about 200 cm×500 cm.

Receiver Table

The receiver table 4 holds the receiver (not shown) during the printing process.

The table 4 is preferably very rigid to counteract deformations.

Shuttle Assembly

The shuttle assembly 3 is the total assembly of the machine components moving over the receiver table 4 and providing the printing action.

Several components are combined in the shuttle

- printheads e.g. for jetting the ink drops onto the receiver
- "header" ink tanks forming a local supply on the shuttling head
- curing lamps for pre-curing or drying the deposited ink in between scanning sweeps thereby rendering the drops non-migratory
- cooling or heating means for conditioning ink and or curing lamps The shuttle assembly 3 rests upon the rails 9 which are mounted upon the metro frame 2. At each side the shuttle assembly 3 can have one or more carriages 11, 13 running on the guidance rails 9 of the metro frame 2.

All the components can be located on a single shuttle but preferably the shuttle is divided into two independent shuttles which can be positioned separately.

The printhead shuttle 12 contains the printheads to print bands of image pixels forming the image during the shuttle 12 scan over the receiver. The printheads are usually mounted in a printhead holder 15 which is a component of the printhead shuttle 12.

The printhead shuttle 12 has at least two carriages 11 which run on the guidance rails 9 mounted upon the metro frame 2.

The position and speed of the printhead has to be exactly controlled to ensure the exact positioning of the ink dots on the receiver to avoid image disturbance.

This shuttle 12 preferably has to be kept substantially vibrationless during printing.

The shuttle 12 may be provided with a mechanism 16 enabling a sideways movement of the printheads situated in the printhead holder 15 to enable to print several neighbouring and (partially) overlapping bands of the image. This depends upon the possible recording schemes used during image printing. Some possible recording schemes have been given above in the prior art and further consequences are addressed further in the description.

Further it has also necessary cooling/heating means to keep the printheads at a desired temperature.

The utility shuttle 14 carries all the utilities accompanying the printing of the image.

This can be e.g.

curing lamps for immobilisation of the deposited bands of ink before printing further bands.

necessary sensors needed for operation or quality control of the printed image.

In the preferred embodiment the utility shuttle 14 runs upon four carriages 13 running upon the guidance rails 9.

The utility shuttle 14 does not need to be totally vibrationless state.

The position of the curing lamps and other utility devices does not need to be positioned as precisely as the printheads and these components can sustain some vibrations without causing failures in their operation.

The separation of several functions of the shuttle assembly 3 over multiple shuttles allows for reducing the weight of the printhead shuttle 12 and gives the possibility to have an even more accurate control over the position of the printheads.

For the large size printing apparatus of the preferred embodiment about 64 printing heads are used each having a dimension of 70×35 mm. The heads are build into a printhead holder 15 which is a part of the printhead shuttle 12 which has extra cooling and each printhead has to be provided with the necessary tubing for ink supply, an accompanying header tank and cabling for driving the printhead and possible vacuum for e.g. ink supply operation. Because of the used recording schemes, the printhead shuttle 12 is further provided with a mechanism 16 to enable sideways movement to allow for complete coverage of the whole print area.

Summing up the weights of all component and the shuttle 12 itself may give a total weight for the printhead shuttle 12 of e.g. about 250 Kg.

For the utility shuttle 14 in the preferred embodiment contains curing lamps, cable and tube chains 5 to allow for scanning of the shuttle assembly 3, cooling etc. As recording is done in both scanning directions, a curing unit is duplicated at both side of the printhead shuttle 12. In the described embodiment the utility shuttle 14 abridges the printhead shuttle 12, but as an alternative two independent utility shuttles 14 could be provided.

The total sum of weights for the utility shuttle 14 may be about 200 Kg but may vary upon the utilities required.

The used system has important advantages:

By using a system for positioning the shuttle assembly 3 of a digital printer over the receiver wherein a printhead shuttle 12, having at least one printhead, and a utility shuttle 14, having at least one utility device, can be positioned independently, the mass of the printing shuttle 12 which has to be positioned with high accuracy is greatly reduced which allows for a cheaper and qualitative better positioning system than if the whole weight of the printing 12 and utility shuttle 14 should be positioning with high accuracy.

Both shuttles 12, 14 can have their own positioning system for positioning the receiver over the shuttle. The position of the shuttles 12, 14 can be tracked using e.g. an magnetic encoder 10. The principle of digitising in a magnetic encoder 10 is similar to that used in optical and in contact devices. The carriers of the digital code marks is a ferromagnetic strip 10 with a pattern of magnetised and non-magnetised areas. A magnetic head 19 responding to the magnetisation is in close proximity of the strip 10 and produces "0" or "1" pulses when magnetised or non-magnetised areas pass the head. A contemporary technique allows the inscription of the magnetic pattern very precisely, providing a high resolution for the transducer.

Preferably a position sensing system is provided at both sides of the metro frame 2.

In the preferred embodiment the positioning system of the utility shuttle 14 is coupled to the printing module.

Each shuttle 12, 14 can also have its own separate guiding system, such as a separate set of guide rails 9 and even separate frames for carrying the guiding systems can be provided.

More preferably both shuttles 12, 14 are located on the same frame, in this case the metro frame 2.

Preferably the shuttles 12, 14 use the same guiding system 9.

An even more detailed description of the printing shuttle 12 and of its functioning and the positioning system will be given further below.

Motor System

In order to operate the printer the shuttles 12, 14 have to be moved by a motor system.

In many printers use is made of a belt drive system in which a tensioned belt is mounted over two pulleys while the a motor drives at least one pulleys and the shuttle is attached to the belt.

As mentioned before, due to the large overall size of the apparatus and the high weight of the shuttles a belt drive system does not provide the needed accuracy.

A high precision alternative in some printers is the use of an linear electrical motor. However, due to the large size, this solution would be too costly.

In a preferred embodiment the solution is given using a motor in motor system capable of moving over a large distance but attaining high resolution positioning.

Figure 2:
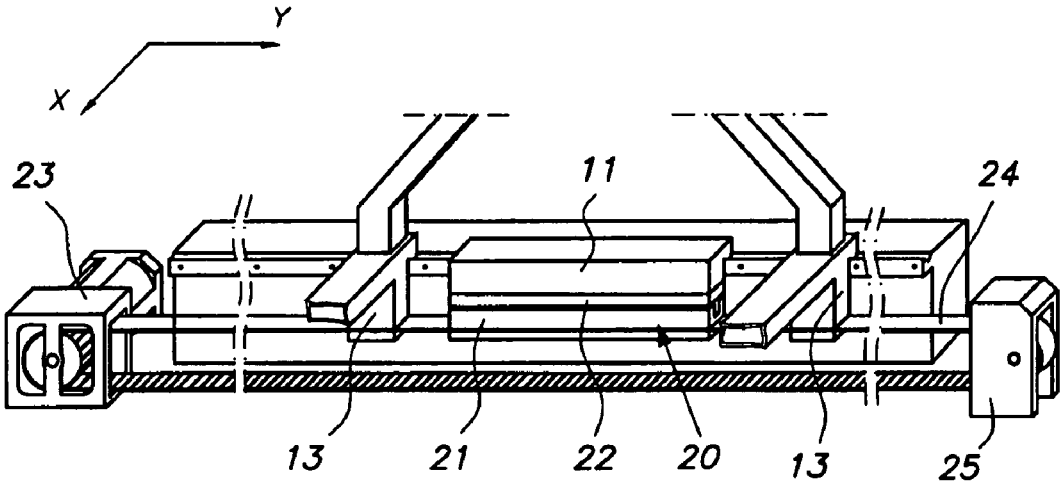
FIG. 2 shows the motor in motor concept of the preferred embodiment.

The solution according to the preferred embodiment is given in FIG. 2.

Generally the solution can be given by a system for moving a printhead shuttle 12 in a digital printer relative to the receiver using a first motor system for inducing, during printing, a relative movement of the printhead shuttle 12 in a first direction, and using a second motor system, wherein the second motor system induces a second relative movement of the first motor system and the printhead shuttle 12 in a second direction.

As can be seen in FIG. 2, in the preferred embodiment the first motor system is a small stroke linear electrical motor 20 providing movement of the printhead shuttle 12 along the guide rail 9 as the rotor 22 of the linear motor is attached to the printhead shuttle 12 while a second motor system provides a long stroke movement by using a belt drive system 23, 24, 25 in which the stator 21 of the linear electrical motor is mounted upon the belt 24 of the belt drive system. This movement is also along the guide rail 9 direction.

The total movement of the shuttle 12 will be a translation movement being a summation of the movements of the first 20 and second motor system.

As can be understood the belt drive provides inaccurate movement of the stator 21 of the linear motor 20 over the large distance to be covered by the printing shuttle 12 while the linear motor 20 provides the accuracy needed in the printing process.

The most important advantage is that, by using the motor in motor concept, it is possible to provide a high accurate placement of the printing shuttle 12 over a large distance at a reasonable price.

Although this motor in motor concept could be used to position a single shuttle carrying all shuttling components comprising printheads and utility devices, the shuttle is, as mentioned above, preferably divided in:

- a printhead shuttle 12 which has to be positioned very accurately and
- is driven by the rotor 22 of the linear motor 20, and
- a utility shuttle 14 which may be moved inaccurately which is directly coupled to the belt 24 of the belt drive system.

This combines the advantages of the properties of the motor systems with the weight of the shuttle assembly 3 divided over the utility and printhead shuttles 12, 14.

The weight of the printhead shuttle 12 to be positioned very accurately is kept as low as possible and therefor the linear motor 20 needed to perform the positioning can be kept as small as possible.

In the preferred embodiment use is made of a belt drive system 23,24,25 as the second motor system and a linear electrical motor 20 as the first drive system.

It is understood that other drive systems can be used as first and second motor systems, however the properties of these drive systems will have an important influence upon the characteristics of the apparatus:

- accuracy which can be obtained by the motor in motor concept
- speed at which the positioning system can operate
- cost of the overall motor drive system.

Embodiments are possible wherein the directions in which the motor systems operate can be very different but preferably the operating directions are very similar.

More preferably the operating directions of the motor systems are parallel as in the preferred embodiment wherein the printhead shuttle 12 and the utility shuttle 14 move along the same guidance system 9.

As can be seen in FIG. 1 a belt drive system, with accompanying electrical linear 20 motor is located on either side of the shuttle assembly 3. This provides sufficient speed and power for quick acceleration and make that acceleration forces are equally spread over the two sides of the shuttle 12 avoiding skew.

It is understood that the rapid acceleration of the shuttles generates a lot of forces in the printer. These forces act upon the printing apparatus via the belt 24, drive motors 23, pulleys 25 and other components if the drive system and may introduce vibrations. According to the invention, the effect of the forces generated for accelerating the total weight of the shuttle assembly 3 upon the printing mechanism can be minimised by designing the printing system with the

- the shuttle assembly 3 comprising the printheads for printing an image on a receiver,
- the metrological frame 2 for supporting and guiding said shuttle assembly 3 along a printing path,
- the base frame 1 for supporting said metrological frame 2;
- the motor drive system for moving said shuttle assembly 3 along said printing path wherein when the motor drive system moves the shuttle assembly 3, the drive and reaction forces on the motor 23 system act upon the base frame 1.

A can be seen in FIG. 1 which is an embodiment according to the invention the belt drive system of the preferred embodiment the motors 23 and the pulleys 25 of the belt drive system are located on the base frame 1. This means that the forces acting upon the motor 23, driving the belt 24, and the forces on the pulleys 25 due to tensioning of the belt 24 are not influencing the components of the printing system itself.

The forces generated by the linear motor 20 act upon the belt 24 on which the stator 21 of the linear electrical motor 20 is coupled and are in this way also deviated to the base frame 1.

The acceleration forces are taken on by the base frame 1, which has a high weight and high sturdiness. The shuttles 12, 14 only rest upon the metro frame 2 and no force are exerted upon the metro frame 2 except for the forces due to gravity.

This system according to the invention avoids the occurrence of vibrations in the metro frame 2 and because the metro frame 2 acts as a reference for the printing engine comprising the receiver table 4 and the printhead shuttle 12, disturbances in the recorded image are avoided.

Preferably the orientation of the drive belt 24 is perfectly parallel to the guidance rail 9 which determines the printing path so that the orientation of the action forces acting upon the shuttle assembly 3 for moving it are parallel to the printing path.

To avoid the transmittance of vibrations from the base frame 1 to the metro frame 2, the metro frame 2 is preferably further isolated from the base frame 1 by vibration isolation means.

As shown in FIG. 1, this can be rubber vibration isolators (dampers) having a low eigenfrequency. According to the present invention preferably the eigenfrequency is lower than 8 Hz. An eigenfrequency is well known in physics as one of the frequencies with which a particular system will vibrate.

Hereinafter more attention is given to the possible recording method used in the printing apparatus and the mechanical consequences of the method.

As mentioned above in the background of the invention use can be made of interlacing and shingling to improve image quality.

When using interlacing the nozzles of the printheads must be capable of reaching intermediate positions during subsequent recording strokes. Also for the shingling method it has to be possible to position other nozzles over lines which are only partially recorded and which has to be completed by other nozzles during subsequent scans of the printhead shuttle 12 over the receiver.

Also using other recording methods wherein sub-images are used a transversal displacement of the printheads to align to different positions on the receiver is needed.

Figure 3:
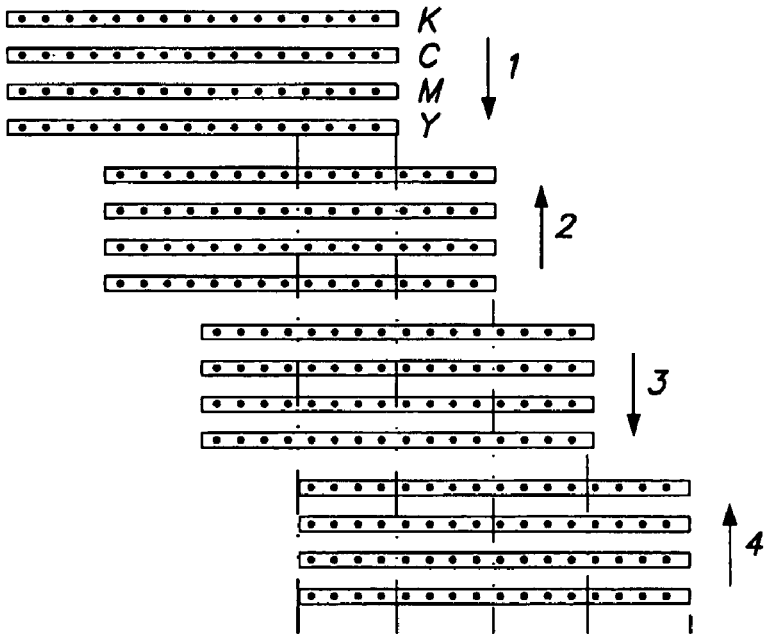
FIG. 3 illustrates the transversal positions of the printheads during the subsequent scanning movements of the shuttle assembly using a possible recording scheme.

In FIG. 3 possible positions of the printheads is given in several recording steps 1 to 4 performed during each scan movement (to and fro) for recording a certain area.

In the preferred embodiment after each passage of the recording heads the deposited drops are rendered non-migratory by use of UV lamps on the utility shuttle 14 at each side of the printhead shuttle 12 to harden the skin of the drops to avoid that drop will runout and mix with neighbouring drops giving rise to printing defects.

In the recording method, using a simple shingling method, illustrated in FIG. 3 in total 4 passes of different nozzles over the covered area are needed to print the whole image.

In order to make the transversal movement of the printheads possible an extra sideway movement mechanism 16 having a motor 17 is provided for transversal shifting of the part of the printhead shuttle 12 carrying the printheads which is hereinafter called printhead holder 15.

Figure 4:
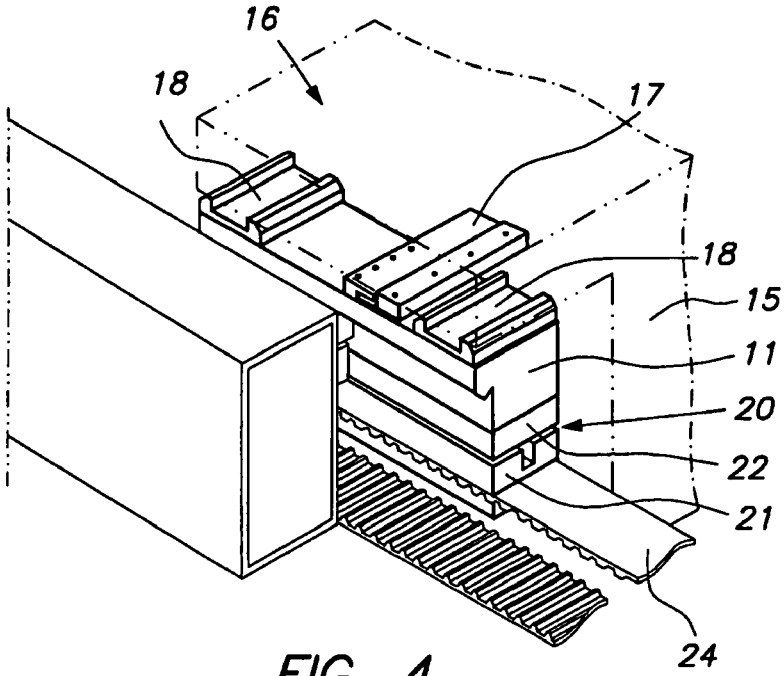
FIG. 4 shows the components for enabling transversal movement of the printhead holder as used in the preferred embodiment.

As shown in FIG. 4 the carriages 11 of the printhead shuttle 12 are provided with a sliding guideways 18 on top of the printhead shuttle carriages 11.

Preferably the printhead holder 15 is supported on three sliding guideways 18 to give a sufficient support base, but constructions using only two or more than three sliding guideways 18 are possible but these solutions demand a much more stringent design and production.

A base of three sliding guideways 18 provides a sufficient area and avoids possible rocking or tensioning due to friction which can occur when supported on e.g. four sliding guideways 18 and the four guideways 18 are not perfectly aligned.

Preferably the three sliding guideways 18 are provided with underlying or overlying flexible mounting devices (not shown).

A practical embodiment, not shown on the drawings is that the sliding guideways are positioned on three special designed hinges formed by e.g. cardan-joints allowing rotation along the Z-axis for providing excellent position controllability of the left and right sides while movement or rotation in other directions is suppressed in a very stiff way.

The movement or the printhead holder 15 itself, which only needs to move over a limited distance, can be done using an extra motor system which can be e.g. a spindle drive system, a accurate belt drive system etc.

In the preferred embodiment this is done using an extra linear electrical motor 17 positioned between the carriage 11 of the printhead shuttle 12 and the printhead holder 15 lying on the sliding guideways 18.

Cable Carrier

In each printer using a shuttling printhead provisions have to be made to control the firing of the printing elements, e.g. nozzles of the inkjet printhead. In small desktop printers this is usually a special lightweight ribbon cable connected to the electronics in the printer and the printhead shuttle 12 moving over across the page which pulls the ribbon cable to and fro.

Small printers usually have small ink tanks incorporated into the printing shuttle 12 which can be exchanged when needed.

Industrial printers however can have plural printheads (in the preferred embodiment up to 64) and consume a lot of ink so that the provided "header" tanks on the printhead shuttle 12 need to be replenished during printing.

This has as a consequence that a lot of cabling, and tubing is needed to drive the printheads with the appropriate data and to supply the ink needed.

Also some tubing is needed for an eventual cooling system of the printheads and, as needed in the preferred embodiment, the cooling of the UV lamp system used for fixing the ink drops after the passing of the printhead shuttle 12.

Also power has to be supplied for the operation of the curing lamps and also some cabling is needed for driving the motor system used for transversal movement of the printhead holder 15, the driving of the linear motor moving with the drive belt, sensors devices etc. This implies a lot of cabling and tubing which, as the dimension of the printing apparatus is very large, implies also a lot of weight. These are usually grouped and ordered using a cable carrier 5 to allow movement which normally is composed out of segments forming together a flexible chain 5. This combined with the rapid acceleration and high speed of the shuttles during printing, also generates drag en vibrations in the printing apparatus.

Preferably a connection is made from the base frame 1 to the utility shuttle 14, which may sustain some vibrations so that neither the metro frame 2 and the printing shuttle 12 is confronted with the forces generated by the considerable cable carrier 5.

A smaller, short distance cable carrier can be provided between the utility shuttle 14 and the printhead shuttle 12 which does bring a lot of vibration and drag into the print system.

To balance the effect of the cable carrier 5 onto the printing system, preferably two cable carriers are provided, one on each side of the base frame 1. These cable carriers both have effects which have to be taken into account when driving the shuttle assembly 3.

Printing Action

Hereinafter is described how a printing cycle is performed.

At first the apparatus is made ready to operate:

all data is prepared and can be readily provided in the correct order from the data processor to the printhead shuttle 12 and the data is, if needed, corrected for specific deviations of the printing apparatus.

The ink supply is made ready, which means that all in levels are brought to optimum and needed vacuum and pressure values are correct.

Temperature of the printheads is within operating range.

If needed the nozzle plates of the printheads are cleaned

The shuttle assembly 3 is put is the starting position and the printhead carrier is a the correct transversal position for the first printing stroke.

The receiver sheet is provided on the receiver table 4.

Printing

When actual printing is started the printing shuttle 12 is accelerated by the linear motors 20 on either side of the printing shuttle 12.

As the stator 21 of the linear motors 20 is coupled to the belt 24 of the belt drive system, reaction forces are transferred from the stator 21 to the belt 24 and through the belt 24 to the motor 23 and belt pulleys 25 on the base frame 1, thus leaving the metro frame 2 relatively uninfluenced by the acceleration.

The position of the printhead shuttle 12 is measured using the magnetic encoders systems 10, 19 at both sides of the metro frame 2. Dependent upon the reading of the magnetic encoder system 10,19 the movement of the linear motor 20 is adjusted.

This encoder measurement and linear motor drive control form a first servo control loop of the total motor system.

The travel distance of the linear motor 20 may be limited to e.g. −4 mm and +4 mm. To avoid that the linear motor will reach the end of stroke the position of the stator 21 has to be corrected.

This is done using the belt drive 23,24,25.

In the preferred embodiment the distance between the printhead shuttle carriage 11 and the utility shuttle carriage 13 is measured by a distance sensor 28.

As soon as the measurement passes a certain value the motors 23 of the belt drive are set into action and the utility shuttle 14 is set to follow the printhead shuttle 12.

While doing this the position of the stator 21 of the linear motor 20 is altered and the linear motor 20 can not reach an end of stroke position.

Although in the preferred embodiment the distance between the shuttles 12,14 is measured, the relative position of the rotor 22 and stator 21 of the linear motor 20 can be detected to drive the belt drive motor 23 or An exact measurement of the stator 21 or utility shuttle 14 can be done using e.g. the magnetic encoder 10.

The measured values are used to control the motor 23 of the belt drive system. This form a second control loop in the present drive system.

Forces generated by the acceleration of the utility shuttle 14 are likewise also transferred to the base frame 1 via the belt 24 and drive pulleys 25 of the belt drive system.

As the shuttle assembly 3 is accelerated it will reach the desired printing speed. The speed of the printing shuttle 12 is kept constant by rapid adjustments of the position of the linear motor 20 which counteracts variations in the position which are caused by vibrations on the drive belt 24 which also act upon the stator 21 of the linear motor 20. The adjustments can be done forward or backwards direction. The whole movement is controlled using the servo control loops 26, 27.

As the shuttle 12 is at printing speed, is also will reach the desired printing location over the receiver table 4.

This is sensed using the magnetic encoder 10 on either side of the metro frame 2.

In accordance with the location of the moving printhead shuttle 12, data is transferred to the printheads and a first swath of the image printed during a first scan.

In the preferred embodiment use is made of ink which can be hardened using UV light. To render the recorded dots non-migratory the outer skin of the jetted ink drops is hardened by UV lamps mounted on the utility shuttle 14 and which follow the printhead shuttle 12.

At the end of the first scan the shuttle assembly 3 is slowed down after the last ink dots are deposited.

When the format of the image to be printed is smaller than the whole receiver table 4 or a receiver is used of smaller size, then it is not necessary that the shuttle assembly 3 uses the total length of the printing apparatus.

At the end of the scan the printhead holder 15 is normally placed in another transversal position dependent upon the chosen recording scheme making use of shingling and/or interlacing.

The shuttle assembly 3 is now likewise accelerated in the reverse direction and at the correct speed and time a second swath of the image is printed by the printheads with a following UV lamp to render printed dots non-migratory.

As can be seen preferably UV lamps are provided at both sides of the printheads to allow for printing during scan and backscan.

As already mentioned above the utility shuttle 14 preferably bridges the printhead shuttle.

If only one-directional printing is required an asymmetrical set-up can be used but such a recording method automatically implies loss of time as the reverse scan takes a lot of time without printing. This gravely influences the throughput.

After the second scan the printhead holder 15 is again moved to a new transversal location and a third scan (the second in the forward direction) is performed.

In a possible recording scheme a total of eight scans is performed thereby recording eight partial images forming the total image and which are intermediately rendered non-migratory by the curing lamp to counteract image artefacts.

The metro-frame 2 and the printing shuttle 14 remain relative vibration-less during printing.

However the acceleration and movement of a shuttle assembly 3, possible weighing about 450 Kg at about 1 m/sec is not possible without vibrations.

Several causes if vibrations can be recognised.

Due to the relative rapid acceleration of the shuttle assembly 3 the shuttle 12 itself will slightly bend and set the shuttle 12 in a light oscillation as the acceleration forces only act upon the supported ends. To avoid the influence of these vibrations the shuttle 12 should have a high stiffness and its construction should also include dampening effects, possibly by dedicated damper, to make sure that these vibrations are quickly dampened before the printing position is reached by the printhead shuttle 12. The eigenfrequency of the shuttle 12 should be at least above 60 Hz and preferably be above 80 Hz.

Due to the unequal, and variable, distribution of the weight of the shuttle 12 between left and right as the printhead holder 15 can be shifted to the left or right side, it is possible that unbalance occurs in the forces at both sides of the metro-frame 2. This will show in different tension of the belt 24, higher forces to be generated by the linear motor 20, etc.

This can generate a skew deformation of the printing system and will influence the properties of the system.

It has been shown that the cable carrier 5 introduces some vibrations with a frequency of about 60 Hz while printing is done at a speed of 1 m/sec.

As it is possible that the centre of weight is situated lower or higher that the point of application of the acceleration forces acting upon the shuttles, torque can be generated acting upon the shuttles 12,14, giving vibration During printing the length of the belt 24 between the shuttles 12,14 and the belt drive motor 23 changes continuously wherein also vibration properties change continuously possibly leading to vibrations.

Although the metroframe 2 is very rigid, some slight bending may occur due to the high weight of the shuttle assembly 3. The value of this bending is of course dependent upon the shuttles position.

All these factors have an influence upon the working of the servos 26,27 of the drive motors.

Generally the function, or task, of a servo can be described as follows.

A command signal which is issued into the servo's "positioning controller". The positioning controller is the device which stores information about various jobs or tasks. It has been programmed to activate the motor/load, i.e. change speed/position.

The signal then passes into the servo control or "amplifier" section. The servo control takes this low power level signal and increases, or amplifies, the power up to appropriate levels to actually result in movement of the servo motor/load.

These low power level signals must be amplified: Higher voltage levels are needed to rotate the servo motor at appropriate higher speeds and higher current levels are required to provide torque to move heavier loads.

This power is supplied to the servo control (amplifier) from the "power supply". It also supplies any low level voltage required for operation of integrated circuits.

As power is applied onto the servo motor, the load begins to move, the speed and position changes.

As the load moves, a tachometer, a resolver or an encoder detects the movement and provides a signal which is "sent back" to the controller. This "feedback" signal is informing the positioning controller whether the motor is doing the proper job.

The positioning controller looks at this feedback signal and determines if the load is being moved properly by the servo motor; and, if not, then the controller makes appropriate corrections. For example, assume the command signal was to drive the load at 1000 rpm. For some reason it is actually rotating at 900 rpm. The feedback signal will inform the controller that the speed is 900 rpm. The controller then compares the command signal (desired speed) of 1000 rpm and the feedback signal (actual speed) of 900 rpm and notes an error. The controller then outputs a signal to apply more voltage onto the servo motor to increase speed until the feedback signal equals the command signal, i.e. there is no error.

Therefore, a servo involves several devices. It is a system of devices for controlling some item (load). The item (load) which is controlled (regulated) can be controlled in any manner, i.e. position, direction, speed. The speed or position is controlled in relation to a reference (command signal), as long as the proper feedback device (error detection device) is used. The feedback and command signals are compared, and the corrections made. Thus, the definition of a servo system is, that it consists of several devices which control or regulate speed/position of a load.

However servos must be compensated to ensure proper operation. Possibly it could operate in at least two distinct modes:

The first mode of operation, the transient state (may also be termed dynamic response state), occurs when the input command changes. This causes the motor/load to accelerate/decelerate i.e. change speed. During this time period, there is an associated 1) time required for the motor/load to reach a final speed/position (rise time),
2) time required for the motor/load to settle and
3) a certain amount of overshoot which is acceptable.

The second mode of operation, steady state, occurs when the motor/load has reached final speed, i.e. continuous operation. During this time, there is an associated following accuracy (how accurate the machine is performing). This is typically called steady state error. The machine could be capable of operating in these two distinct modes in order to handle the variety of operations required for machine performance. And in order that the machine will perform without excessive overshoot, settle within adequate time periods, and have minimum steady state error, the servo can be adjusted or compensated.

Compensation involves adjustment or tuning the servo's gain and bandwidth. First of all, a look at the definition of these terms is in order and then how they affect performance. Gain is a ratio of output versus input.

Gain, therefore is a measure of the amplification of the input signal. In a servo controller, gain effects the accuracy (i.e. how close to the desired speed, or position is the motor's actual speed or position). High gain will allow small accurate movement and the machine will be capable of producing precise parts.

Bandwidth is expressed or measured in frequency. In a servo, bandwidth is a measure of how fast the controller/motor/machine can respond. The wider the bandwidth, the faster the machine can respond. Fast response will enable the machine to react rapidly. However the bandwidth has to be limited due to 1) limitations of the components which can handle only so much power. In addition, increasing gain adds components, cost, complexity.
2) resonant conditions determine that some frequencies are to be avoided. Machines must not be operated at the resonant point otherwise instability and severe and damage will occur. In a printing apparatus as in the preferred embodiment this would quickly lead to visible disturbances in the image.

In conclusion, normally servos are compensated or "tuned" via adjustments of gain and response so that the machine will operate satisfactory.

This can be done by setting a simple low-pass filter but also more complicated filters exist. An example is e.g. a biquadratic filter in which more parameters can be set.

However due to the complexity of the apparatus of which the properties continuously change during operation and the wish to obtain a high throughput, it is impossible to just set the gain and bandwidth at a desired value without losing significantly dynamic properties of the servo controls, leading to lower performance and throughput.

A much better control can be obtained using a servo control having a certain compensation intelligence and adaptive digital filtering in the feedback loop wherein the intelligence and digital filtering will adapt the servo control parameters to the actual system properties.

A better control over the positioning of the printhead holder 15 is given by a system, having at least one shuttle 12, and which comprises at least one servo control system 26, wherein the servo control system 26 has compensation intelligence which specifically adapts for changes in resonance properties of the positioning system.

The positioning system includes the motor system, rails 9, frame and measurement systems.

The adaptation avoids the occurrence of resonant oscillations which would lead to image artefacts or even non-functioning of the printing apparatus.

The system with the compensation intelligence preferably has a servo control system 26 including at least one gain scheduling feature. The gain of the servo loop 26 has to be controlled and can be managed using a specific schedule.

As the method of driving the linear motor system for printing automatically includes driving the belt drive 23,24,25 it is preferable that the control system includes a feed forward steering. This means that the second motor system 23,24,25 is already started when the first motor system 20 is set into movement to anticipate to the inevitable start when the shuttle distance falls outside the desired value. This means that the slave control system 27 also receives the target position/velocity of the master control system 26, so that is can actuate the slave drive already before a position/velocity of the master control 26 system occurs, i.e. the slave control system can anticipate placement/velocity errors in the master control system. Feed-forward control avoids large placement/velocity errors in the master control loop 26 and broadens the bandwidth of the overall motion control system.

The control system uses a compensation intelligence taking into account the position of the printhead shuttle 12. This means that depending upon the position of the printhead shuttle 12 along the rails 9 and depending upon the position of the printhead holder 15 (between left and right extreme transversal positions) filtering is adapted.

Preferably also the acceleration of the printhead shuttle 12 is taken into account by the compensation intelligence to obtain an optimal feed forward steering. This acceleration can be estimated by using the drive control signals but can be also measured using the position detecting system 10,19 on the metro frame 2.

Normally the shuttle in the control system is the printhead shuttle carrying the printheads A preferred embodiment using the two motor systems the servo system 26 includes a hierarchic architecture for controlling two motor systems wherein a second servo 27 is hierarchical subordinated to the first servo 26.

In the preferred embodiment the system comprises a second servo 27 system wherein the first servo system 26 includes a linear motor 20 and the second servo system 27 includes a belt drive system.

In the preferred embodiment the stator 21 of the motor of the first servo system 26 is located on the belt 24 of belt drive of the second servo system 27. In the described embodiment this is the same base as whereon the utility shuttle carriages 13 are mounted.

To have the desired properties the first servo system 26 is a high accuracy positioning system and the second servo system 27 is a positioning system having a lower accuracy.

Depending on the construction of the printing apparatus it is preferable that the compensation intelligence takes into account the influence of the cable carrier 5.

The master-slave configuration of the servo control loops 26,27 as discussed above is only one possible embodiment of two servo drive systems 26,27 using a hierarchic architecture for controlling two servo drive systems wherein a second servo drive system is hierarchical subordinated to a first servo drive system. In the embodiment the system comprises a first servo system including a linear motor 20 and a second servo system 27 including a belt drive system. In a preferred embodiment the stationary part of the linear motor of the first servo system is mounted on the belt of belt drive of the second servo system.

Figure 5A:
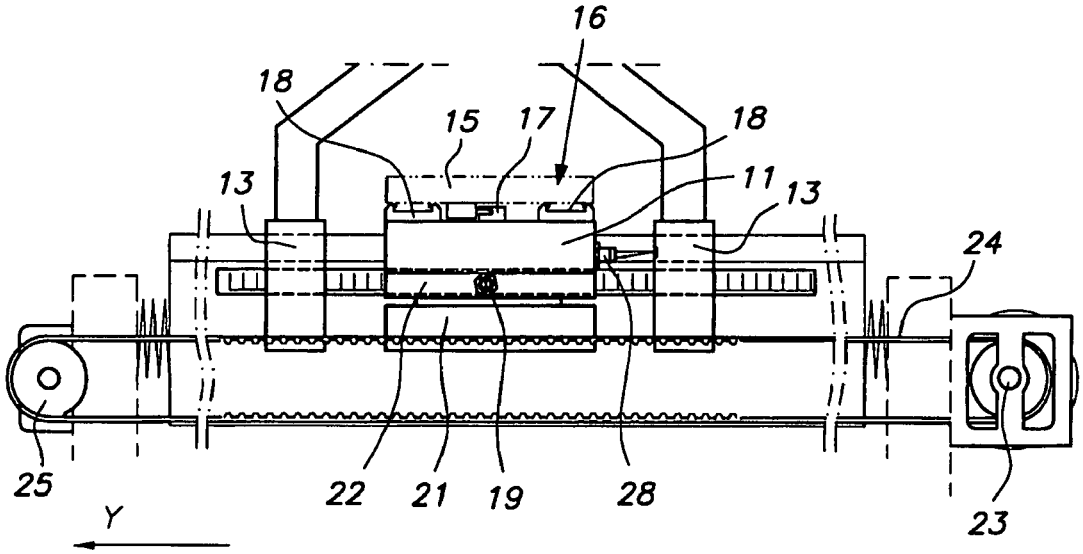
FIGS. 5A and B Illustrates the position of the elements of the master slave servo control system.
Figure 5B:
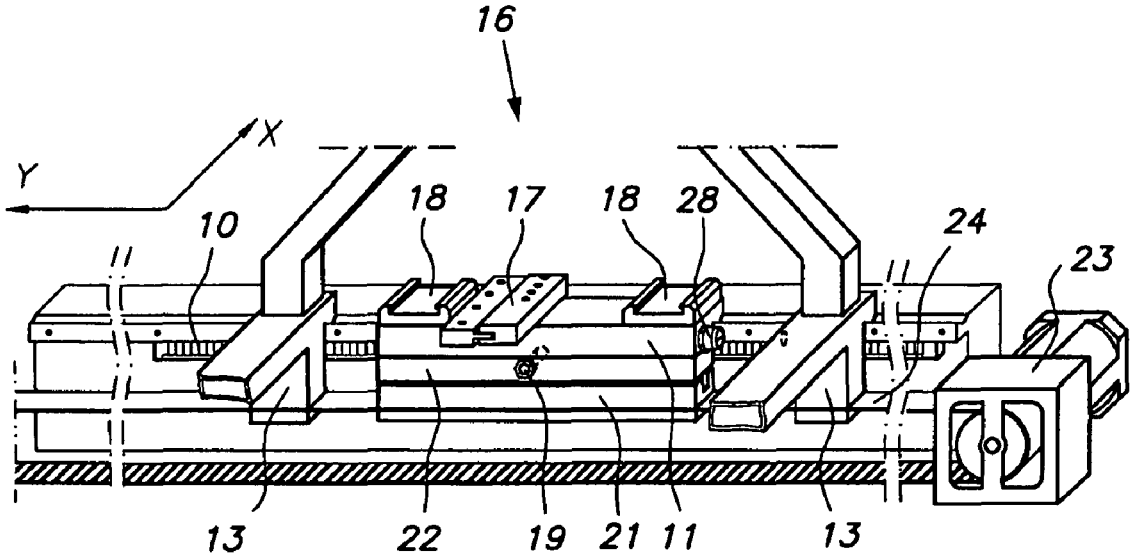

FIGS. 5A and 5B show the components influencing the working of the servo systems as can be used in the described embodiment according to the invention:

Floor on which the apparatus is positioned

Base frame 1

Metro frame 2 resting on the base frame 1 separated by vibration isolators Belt drive motor 23 on the base frame 1

Belt 24 for driving the utility shuttle 14

Utility shuttle 14 and stator 21 of linear motor 20

Printhead shuttle 12 with coupled rotor of the linear motor 20.

Position sensor 10,19 detecting the position of the printhead shuttle 12.

Distance sensor 28 indicating relative position of the printhead shuttle 12 (+linear rotor) and utility shuttle 14 (+linear stator).

Figure 6A:
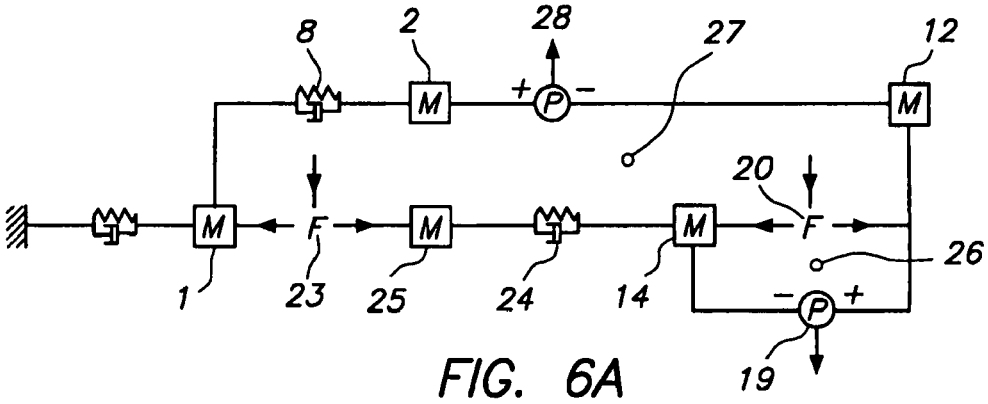
FIG. 6A gives the schematic diagram of the servo control of the motor in motor drive.

FIG. 6A give the equivalent dynamic model of the same system. The model only shows one side of the printing drive and therefore could be doubled. Each component is depicted as a mass while the interaction between the masses is represented as a component acting as a spring and a parallel component acting as a damper between the masses.

The base frame 1 is posed on the floor using small feet and even these feet have parameters determining the interaction between the floor and base frame 1.

As a result of the present invention the vibration isolators between the base frame 1 and the metro-frame 2 give the interaction parameters between them leaving the metro-frame relatively force free and vibrationless.

On the other hand, as a result of the invention, the forces of the slave motor 23 acts between the base frame 1 and the mass of the belt drive motor 23 which is set into movement by the rotation.

The belt 24 itself determines the interaction between the moving mass of the motor 23 and the mass of the utility shuttle 14 with the stator 21 of the linear motor 20.

The forces of the linear motor 20 act between the mass of the utility shuttle 14 and mass of the printhead shuttle 12.

The measurement device 28 measure the position of the mass of printhead shuttle 12 relative to the mass of the printhead shuttle 12 (distance sensor) and the position of the mass of the printhead shuttle 12 to the mass of the metro frame 2 (magnetic encoder system 10,19).

Due to the variation of the distribution of the weight, length of the belt 24 between motor 23 and shuttle 14, all the parameters can vary.

Due to the transversal movement of the printhead holder 15 the mass of the printhead shuttle 12 acting on one side can also vary.

The influence of the cable carrier 5 is not included in this model but could be included if needed.

As said above, the model only gives the components of one side of the printing apparatus and an adaptive digital filtering device is provided for each side of the apparatus.

The second model could be added for the other side wherein the mass of the frame could be common.

Figure 6B:
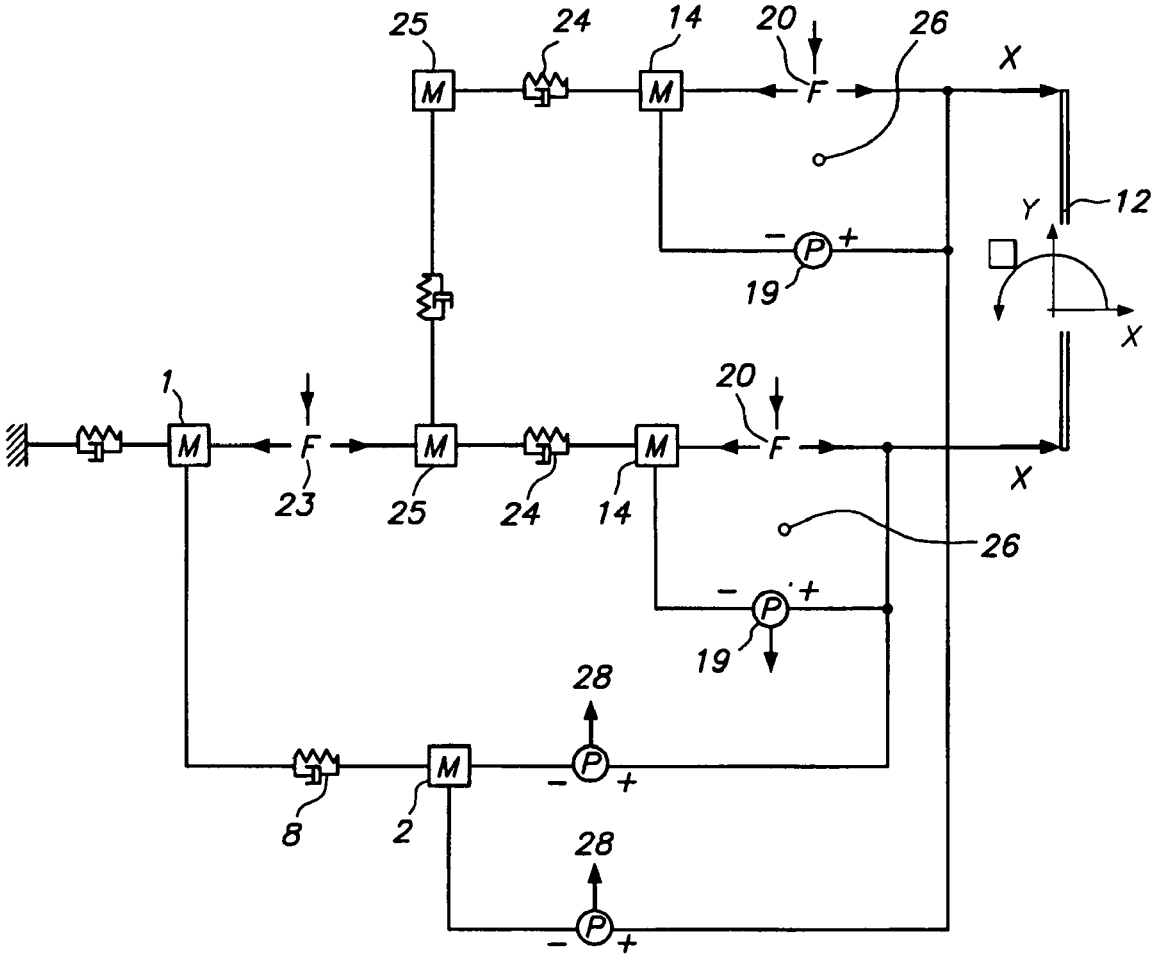
FIG. 6B gives a schematic diagram of the servo control system using a single slave actuator for both motor in motor systems on either side of the base frame.

An integrated servo control system is shown in FIG. 6B that could be provided wherein all measurements serve as input and the adaptive digital filter provides filtering based upon the measurements at both sides of the printing apparatus. A single belt drive motor 23 is provided and the pulleys 25 on either side of the metro-frame 2 are coupled by a cardan shaft.

The system has due to its characteristics resonant and anti-resonant points which however change in frequency and magnitude due to changing characteristics. As filtering technique use can be mode of a moving notch filter but more complicated digital filtering techniques are needed.

The aim of the digital filtering device is to regulate gain over a desired frequency range and filter certain frequencies out of the measurement signal and feedback loop. The filtering also can adapt for expected reaction or dynamic behaviour of the frames 1, 2 during operation.

Even a system can be developed in which the digital filtering system has a "auto-tuning function" wherein the filtering adjusts itself to obtain ideal filtering parameters for the specific configuration and even for small variations in design of the printing apparatus influencing the dynamic behaviour.

Preferably the occurrence of disturbing resonance phenomena are to be avoided by adapting favourable mechanical design parameters, thus possibly avoiding the need for complicated filtering techniques.

The feed forward in the system compensates for the elasticity of the belt. When starting the belt drive 23, the belt 24, due to the exerted forces elongates about 1.5 mm and the utility shuttle 14 with the linear stator 21 will start to move a little while after the motor 23 of the belt drive is started. To enable smooth operation the belt drive 23,24,25 should be started in advance so the linear motor 20 moves at the right time with the right speed.

It can be understood that the feed forward is different for the scan and back-scan movements as the belt length between the shuttle 14 and motor 23 also differs.

Likewise to the feed forward, when stopping the shuttle 14, the de-tensioning of the belt 24 and accompanying shortening of the belt segment has to be taken into account. Rotation of the belt drive can be stopped a bit earlier As mentioned above the printhead shuttle 12 is accelerated by the linear motor 20 whereafter the belt drive is started. This means that the linear motor 20 has to be able to accelerate the total weight of the printhead shuttle 12 rather rapidly and the belt drive only accelerates the utility shuttle 14.

This means that the high precision linear motor 20 has to be very large and therefore more costly and heavy.

An alternative configuration could be made if use is made of a configuration in which the utility shuttle 14 pushes the printhead shuttle 12 to operating speed.

At the start of the scan the belt drive 23,24,25 is started first and the back side utility shuttle 14 is allowed to make contact to the printhead shuttle 12 in a controlled manner. Then the combined mass of both shuttles 12, 14 can be accelerated the by the belt drive motor 23. Once at operating speed the linear motor 20 only has to provide a small acceleration for separating the printhead shuttle 12 from the utility shuttle 14 to reach normal print operation as described above.

During the deceleration after printing the printhead shuttle 12 could be docked to the front side of the utility shuttle 14 and the belt drive motor 23 could provide deceleration of both shuttles 12, 14 without the linear motor being involved until the shuttle assembly 3 is stopped. Then the shuttle assembly 3 is again accelerated in the reverse direction by the belt drive 23,24,25, thereby also pushing the printhead shuttle 12 to the operating speed. The linear motor 20 then again brings the printing shuttle 12 free from the utility shuttle 14 and printing can begin. This would allow for a less powerful and thus lighter and cheaper linear motor 20 further reducing the weight of the shuttle assembly 3.

Such an operation preferably includes the use of servocontrols having distinct modes of operation with parameters set to the acceleration/steady state/deceleration circumstances.

Having described in detail preferred embodiments of the current invention, it will now be apparent to those skilled in the art that numerous modifications can be made therein without departing from the scope of the invention as defined in the appending claims.

REFERENCE NUMBERS

1 Base Frame
2 Metrological or Metro Frame
3 Shuttle assembly
4 Receiver table
5 Cable Carrier
6 Side beams of base frame
7 Traverse beams of base frame
8 vibration isolators
9 guide rails or guidance mechanism
10 magnetic encoder
11 carriage of printhead shuttle
12 printhead shuttle
13 carriage of utility shuttle
14 utility shuttle
15 printhead holder
16 sideways movement mechanism
17 motor for sideways movement mechanism
18 sliding guideways
19 magnetic head sensor
20 linear motor (first motor system)
21 stator of linear motor
22 rotor of linear motor
23 belt drive motor
24 belt
25 pulleys
26 first servo loop
27 second servo loop
28 distance sensor system

The invention claimed is:

1. A digital printing system comprising:

a base frame;

a shuttle assembly including at least one printhead shuttle including at least one printhead arranged to print an image on a receiver;

a motor drive system arranged to move the shuttle assembly;

a receiver table arranged to hold the receiver; and a metrological frame including a device arranged to determine a position of the at least one printhead shuttle with respect to the metrological frame; wherein the metrological frame is indirectly supported by the base frame;

the motor drive system is directly mounted on the base frame such that drive and reaction forces generated during movement of the shuttle assembly act upon the base frame and not the metrological frame; and the receiver table is directly supported by the metrological frame and indirectly supported by the base frame.

2. The digital printing system according to claim 1, wherein the device arranged to determine a position of the at least one printhead shuttle with respect to the metrological frame includes at least one encoder.

3. The digital printing system according to claim 2, wherein the metrological frame is indirectly coupled to the base frame via at least one vibration isolator.

4. The digital printing system according to claim 1, wherein the motor drive system includes a belt, two pulleys, and a drive motor arranged on the base frame.

5. The digital printing system according to claim 4, wherein the metrological frame is indirectly coupled to the base frame via at least one vibration isolator.

6. The digital printing system according to claim 4, wherein the at least one printhead shuttle includes a linear motor arranged to move the at least one printhead shuttle relative to the belt of the motor drive system.

7. The digital printing system according to claim 1, wherein the drive and reaction forces of the motor drive system act upon the shuttle assembly in an orientation parallel to a printing path.

8. The digital printing system according to claim 7, wherein the metrological frame is indirectly coupled to the base frame via at least one vibration isolator.

9. The digital printing system according to claim 1, wherein the metrological frame is indirectly coupled to the base frame via at least one vibration isolator.

10. The digital printing system according to claim 9, wherein the at least one vibration isolator has an eigenfrequency lower than 8 Hz of the metrological frame to the base frame.

11. The digital printing system according to claim 1, wherein the shuttle assembly further includes a utility shuttle arranged to be moved independently of the at least one printhead shuttle, the utility shuttle including at least one curing lamp.

* * * * *